US011321990B2

(12) United States Patent
Knipp et al.

(10) Patent No.: US 11,321,990 B2
(45) Date of Patent: May 3, 2022

(54) GAMING PRESENTATION SYSTEMS AND METHODS WITH IMPROVED MUSIC SYNCHRONIZATION

(71) Applicant: Everi Games, Inc., Austin, TX (US)

(72) Inventors: Lawrence J. Knipp, Austin, TX (US); Jarim Cardenas, Austin, TX (US); Michael Conway, Austin, TX (US)

(73) Assignee: Everi Games, Inc., Austin, TX (US)

( * ) Notice: Subject to any disclaimer, the term of this patent is extended or adjusted under 35 U.S.C. 154(b) by 21 days.

(21) Appl. No.: 17/061,359

(22) Filed: Oct. 1, 2020

(65) Prior Publication Data

US 2021/0110631 A1 Apr. 15, 2021

Related U.S. Application Data

(60) Provisional application No. 62/914,791, filed on Oct. 14, 2019.

(51) Int. Cl.
*G07F 17/32* (2006.01)
*G07F 17/34* (2006.01)

(52) U.S. Cl.
CPC ..... *G07F 17/3204* (2013.01); *G07F 17/3213* (2013.01); *G07F 17/3223* (2013.01); *G07F 17/34* (2013.01)

(58) Field of Classification Search
CPC ..... G07F 17/3204; G01H 1/368; G01H 2220/005
See application file for complete search history.

(56) References Cited

U.S. PATENT DOCUMENTS

2008/0225511 A1* 9/2008 Obermeier ..... G07F 9/02 362/86
2019/0051276 A1* 2/2019 Lathrop ..... G10H 1/0008

* cited by examiner

*Primary Examiner* — David L Lewis
*Assistant Examiner* — Robert E Mosser
(74) *Attorney, Agent, or Firm* — Nathan H. Calvert; The Culbertson Group, P.C.

(57) ABSTRACT

A slot machine, gaming method, and program product are provided to dynamically display visual and audio content to be played in synchronization with a music track. A digital signal processor performs frequency analysis of background music as it is played, and identifies musical beats to create beat events. The beat event is used to trigger additional presentation elements such as visual effects, sounds, and lighting on the beat of the background music. Spectral content information from the frequency analysis is used to create dynamic background graphics.

12 Claims, 8 Drawing Sheets

GAMING PRESENTATION SYSTEMS AND METHODS WITH IMPROVED MUSIC SYNCHRONIZATION

CROSS-REFERENCE TO RELATED APPLICATION

Applicant claim the benefit, under 35 U.S.C. § 119(e), of U.S. Provisional Patent Application No. 62/914,791 filed Oct. 14, 2019, and entitled "Gaming Presentation Systems and Methods with Improved Music Synchronization." The entire content of this provisional application is incorporated herein by this reference.

TECHNICAL FIELD OF THE INVENTION

The invention relates to multimedia displays for wagering games and synchronizing the same with music soundtracks.

BACKGROUND OF THE INVENTION

Various slot machine games are known that provide wagering games in a variety of ways. These games often have background music or a musical soundtrack, which may be consistent with a theme of the game or may include popular music or other suitable soundtrack music.

U.S. Pat. No. 8,435,118B2 describes an audio system operable to play a bonus sound and a bang-up sound at the same time, such that the bonus and bang-up sounds are synchronized rhythmically.

Historically, the synchronization of multimedia elements with a background music track was accomplished by authoring all content to align with a specific beat. The content and background music would need to be started at the same time, and volume or display settings were used to mimic turning 'on' and 'off' various aspects of the presentation. This approach required all content to be re-authored for each background song and limited the synchronization to music tracks of a pre-decided temp.

What is needed are better ways to synchronize designated musical tracks with the presentation of a slot machine game, in order to increase player excitement and enjoyment of slot machine games.

SUMMARY OF THE INVENTION

The invention solves the problem of being able to dynamically display visual and audio content to be played in synchronization with a music track. The approach described in this invention allows the flexibility of creating a dynamic arrangement which allows any display elements and sound samples to be played in synchronization with any music track. A slot machine, gaming method, and program product are provided to dynamically display visual and audio content to be played in synchronization with a music track. A digital signal processor performs frequency analysis of background music as it is played, and identifies musical beats to create beat events. The beat events and our spectral content information are used to trigger additional presentation elements such as visual effects, sounds, and lighting on the beat of the background music. Spectral content information from the frequency analysis is used to create dynamic background graphics.

According to a first embodiment, a method is conducted in cooperation with gaming machine having a display, a wager input device, a display, an audio device, and at least one electronic controller operatively coupled to the wager input device, and the display and configured to execute instructions related to a wagering game. The method includes causing the audio device to play audio from an audio file, and while causing the audio file to played, analyzing the audio file at a digital signal processor (DSP) to identify musical beats and creating beat events in response. The method also includes analyzing the audio file using one of a fast fourier transform or frequency analysis to identify spectral content information concerning audio being played. Using the spectral content information, the method selects at least one of a color and a light intensity level at which to activate a plurality of LEDs arranged along bezels of the gaming machine and causing LED drivers to activate the LEDs. The method transmits the beat events and the spectral content information to one of the electronic controllers. The beat events are received at one of the electronic controllers and, in response to the beat events and synchronized with the beats in the played audio, graphic elements are animated on the display during a game play session at the gaming machine. Dynamic background graphics are presented on the display based on the spectral content information.

In some implementations, the dynamic background graphics include a regular pattern of colored elements at least some of which are arranged in a group having displayed brightness levels varying within the group according to the spectral content information. The colored elements may be altered to conform to color changes of the LEDs in response to designated changes in the spectral content information.

In some implementations, the beat events and spectral content information are transmitted to multiple gaming machines in a bank of gaming machines, which use the information to control dynamic background displays in synchronization with the music.

In some implementations, causing the audio device to play the audio file and analyzing the audio file are performed at an audiovisual assembly coupled to the gaming machine.

In some implementations, the method includes, under control of one of the electronic controllers, providing game event audio accompanying selected events in the game play session, and further operable to mix the game event audio with the played audio such that designated sounds in the game event audio are synchronized with the beats in the played audio.

In some implementations, the wagering game includes multiple paylines which are evaluated for game results in a payline evaluation of the game play session, the method further including a graphical display of cycling through the payline evaluation synchronized with the beats in the played audio.

In some implementations, the method further includes synchronizing animations of gaming symbols on an array of symbols with beats in the played audio Another version of the invention is a software or software/firmware program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. Program code is included for the steps performed by the DSP and the steps performed by electronic controllers at the gaming machine. The software also includes the various gaming processes that receive beat messages and respond with various programmed activity to synchronize the presentation.

Another version of the invention is a gaming system that includes one or more gaming servers, and a group of electronic gaming machines connected to the servers by a network, programmed as set forth above. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results received from the server in an entertaining manner. However, other embodiments might use a thin client architecture in which the animation is also conducted by the server, and electronic gaming machines serve merely as a terminal to receive button or touch screen input from the player and to display graphics received from the server.

Different features may be included in different versions of the invention. In some versions, beat events are sent as an inter-process message on a virtual unified message bus. Such messages may be sent between networked devices, over a local bus, or to different processes in the same processor, which may be running on different processor cores or the same processor core. In some versions, new songs may be provided from various sources, or an audio track or stream may be provided including several songs, such as a live concert stream, which could be at a casino or a concert recording.

These and other advantages and features of the invention will be apparent from the following description of representative embodiments, considered along with the accompanying drawings.

DESCRIPTION OF REPRESENTATIVE EMBODIMENTS

Figure 1:
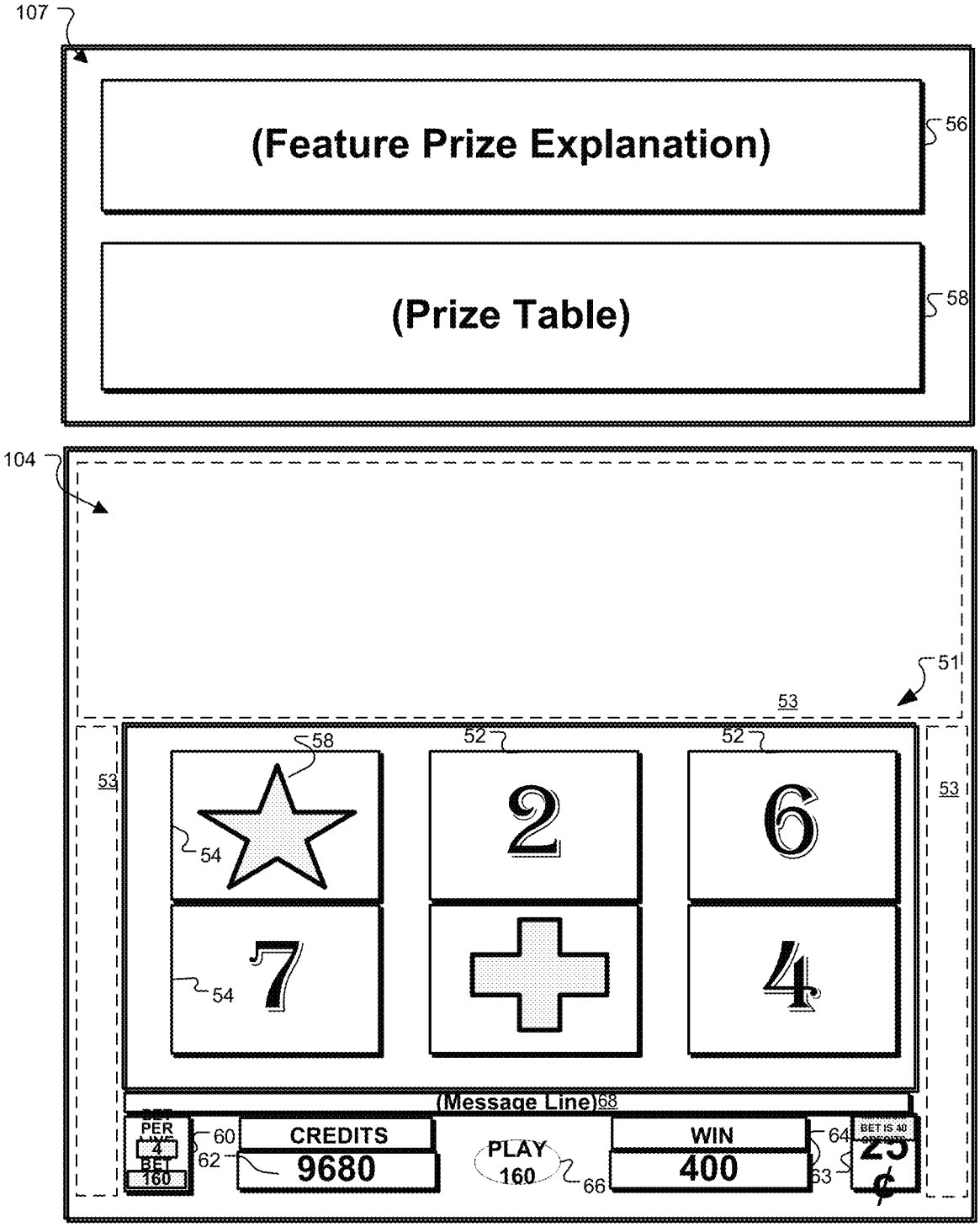
FIG. 1 is a screen display diagram showing the primary display and secondary (top) display to illustrate an example slot machine display arrangement.

FIG. 1 is a screen display diagram showing the primary display 104 and secondary (top) display 107 to illustrate an example slot machine display arrangement on which wagering game results are presented in a gaming area, typically found on the primary display. On the secondary display 107 in box 56 are the instructions for playing the game. Underneath the instructions, a prize table is shown in box 58, are the prizes that can be won as well as the requirements for winning. Background graphics 53 are animated during or between games as part of the multimedia theme of the game as further discussed below.

The gaming area of a reel-type primary game (as opposed to bonus games or other special games) in this version is a matrix 51 of symbol locations arranged in rows and columns to represent simulated slot machine reels that are spun to conduct a game round. Other embodiments may, of course, use other types of game displays to display randomizing of symbols according to the methods herein. The depicted columns of symbols labeled 52 represent the simulated reels, while symbols are designated 54. In this instance there are three reels with two symbol locations 54 displayed at a time on each reel, but the game can be played with more and less reels. The simulated reel typically has far more symbols than those displayed, and as many unique stop positions as there are symbols on the simulated reel. The stop position may be counted, for example, by numbering the symbols on the simulated reel and using the number of the symbol at the bottom of the display window (the three symbols displayed in this example), or at the top or middle. Further, while multi-symbol reels are shown, other versions may use simulated uni-symbol reels, or a reel that has many symbols thereon but only a single window to the reel simulated, displaying a single symbol from the reel. Some variations of the present invention may use a simulated uni-symbol reel in each depicted symbol location 54. Surrounding the matrix 51 is background graphics 53, which may be above, beside, below, between or behind the symbol locations 54 of matrix 51.

Winning patterns are typically formed by matching symbols along defined paylines that pass through the matrix 51. Box 60, which displays the current wager and amount bet per payline. To the right of box 60 is box 62, which displays the current credits in the player's account. In the bottom center a touchscreen play button 66 is presented in the lower central area of the display, which may show other game state related graphics. Right of this is win box 64, which displays the player's last awarded winnings. The wager credit denomination is shown in box 63. Along the bottom edge of the matrix 51 there is a message line, where the game station can display further instructions to the player.

Figure 2:
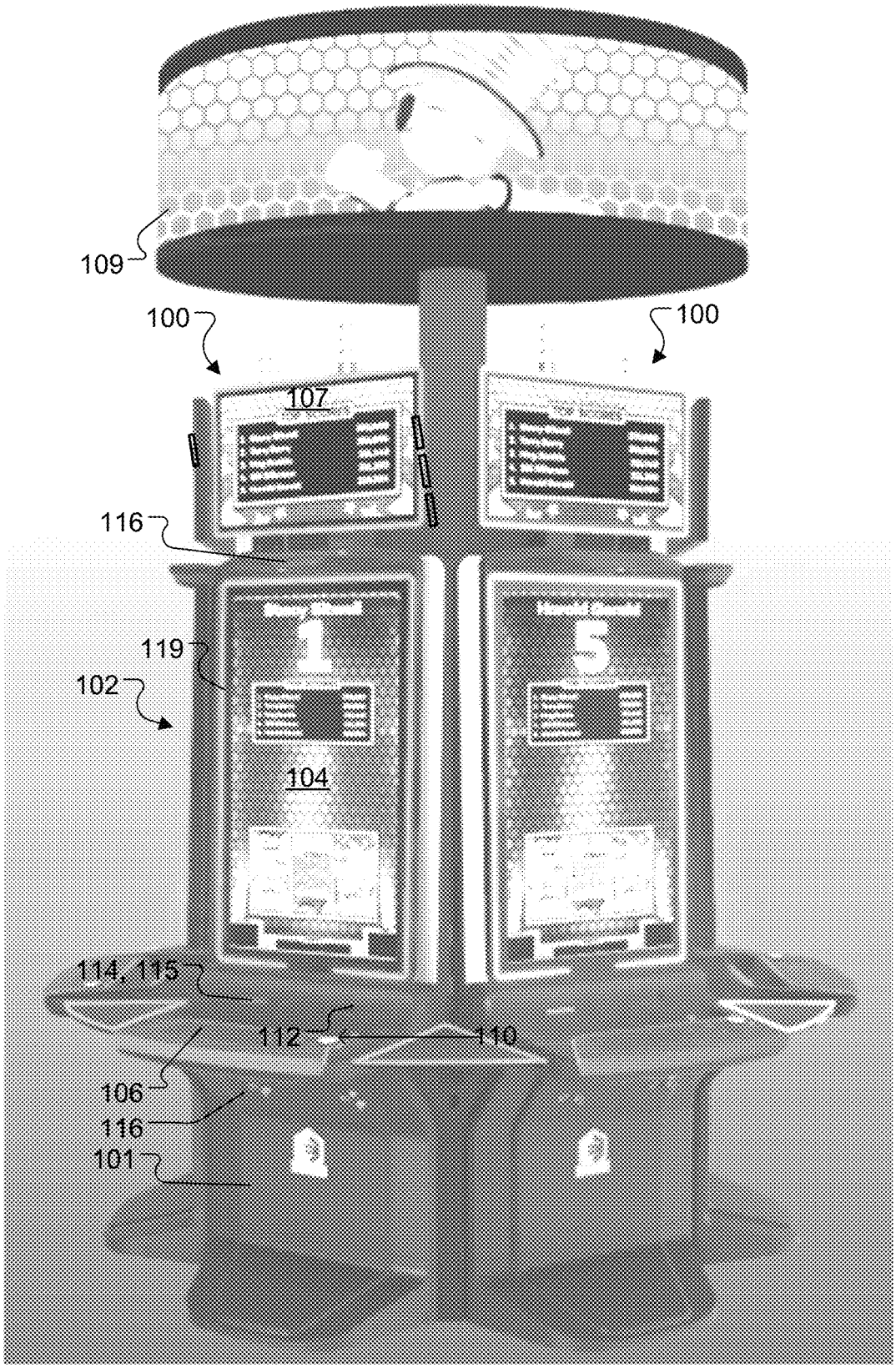
FIG. 2 is a front perspective view of a group of gaming machines which may be used in a gaming system embodying the principles of the present invention.

FIG. 2 shows a bank of gaming machines 100 that may be used to implement an automated multimedia gaming presentation according to the present invention. Referring to FIG. 2, each gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 2 also includes a number of mechanical control buttons 110 mounted on ledge 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. LED bezels 119 are placed, in this version, along the top of the machine and beside secondary display 107, but may also be in other suitable locations such as along the machine's belly (the front panel under the ledge 106) or behind translucent portions of the machine belly glass, around primary display 104, or on the cabinet sides as well. These lights may be controlled to dim, flash, change colors, or otherwise alter along with the musical beats as described herein. Numerous other types of devices may be included in gaming machines that may be used according to the present invention.

A rounded group display 109 is used in this version, mounted on a pole above the bank of gaming machines 100, which are arranged in an outward facing circle. Side-by-side banks of gaming machines are also used.

Figure 3A:
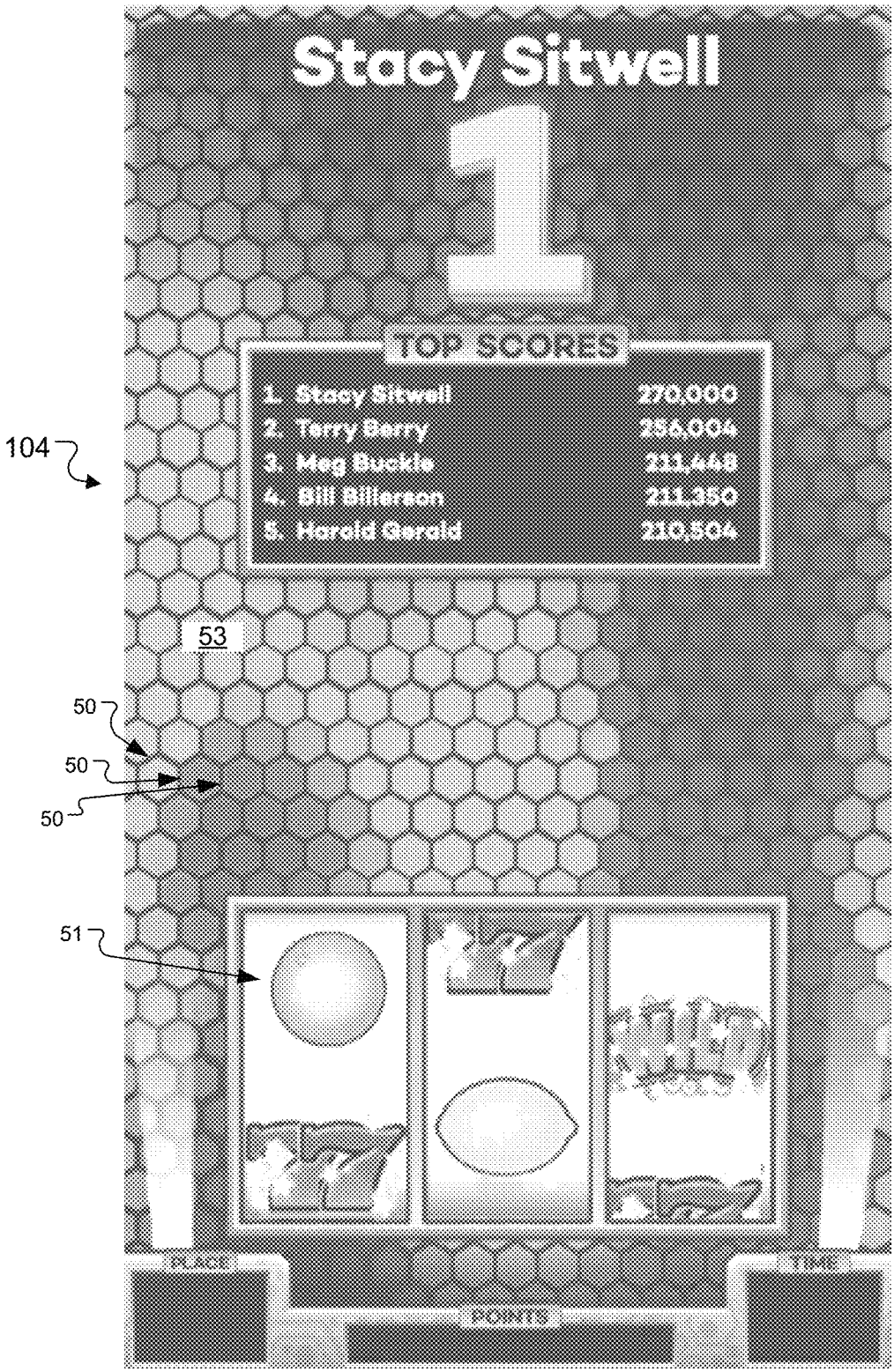
FIGS. 3A-3B shows a sequence of screenshot view for a primary display 104 of a gaming machine playing in a group tournament mode.
Figure 3B:
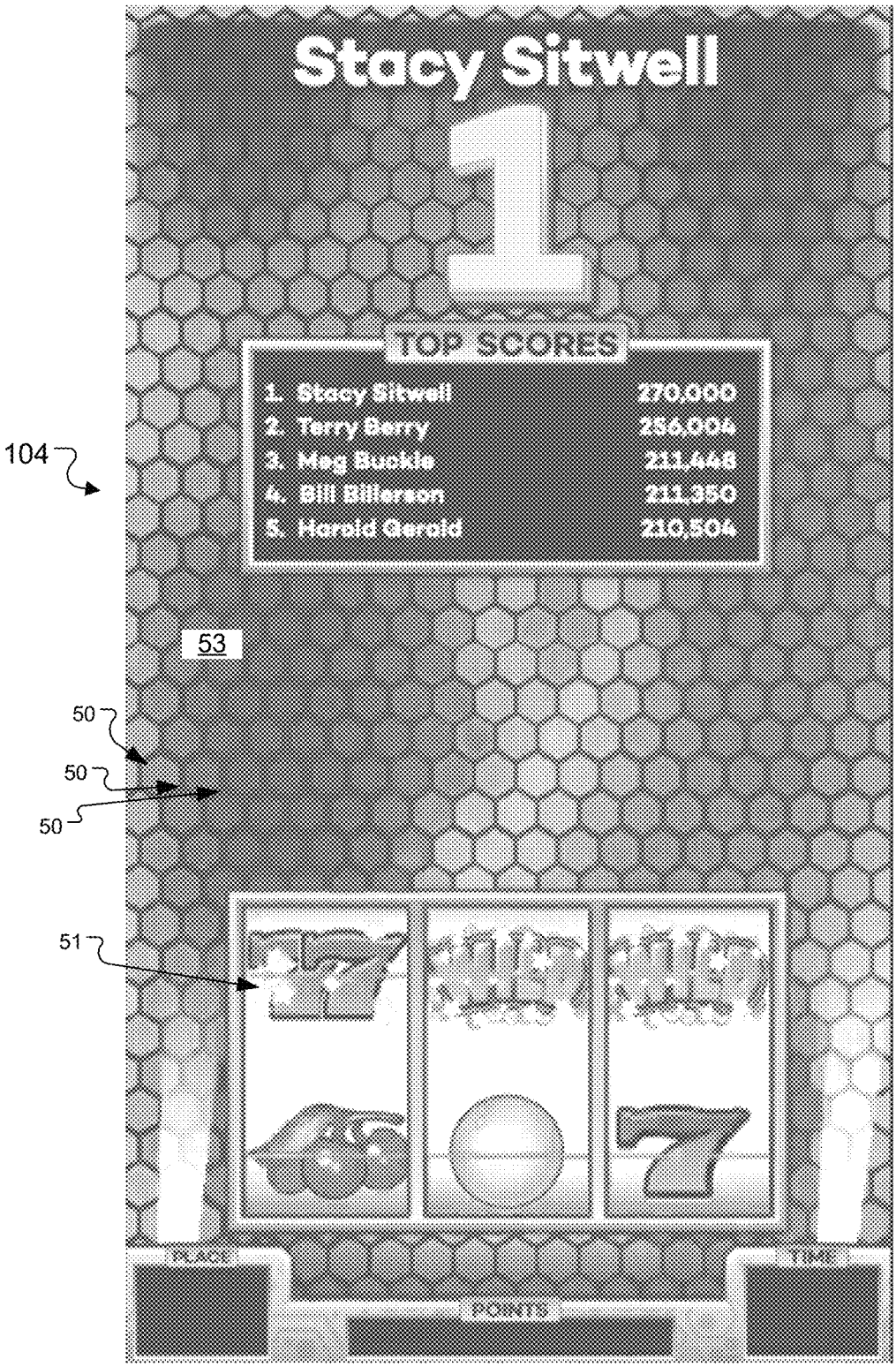

FIGS. 3A-3B shows a sequence of screenshot view for a primary display 104 of a gaming machine playing in a group tournament mode. Primary display 104 includes matrix of symbol locations 51, various tournament status information, and background graphics 53.

In this embodiment, the background graphics 53 include a regular pattern of colored elements 50 at least some of which are arranged in a group having displayed brightness levels varying within the group according to the spectral content information. As can be seen in change between FIGS. 3A to 3B, colored elements 50 change their brightness levels to display a field with groups of colored elements having constantly varying brightness to reflect spectral content of the background audio, as further described below. Generally colored elements 50 in this version are configured as a field of hexagons that display a constantly-varying "graphic equalizer" effect centered around the darker depicted areas and varying into the lighter areas to depict audio power content across various frequencies. Colored elements 50 typically have a base color which is adjusted to match that of LED bezels 119 as changes are made to the LED color, thereby changing the color scheme of gaming machine 100.

Figure 4:
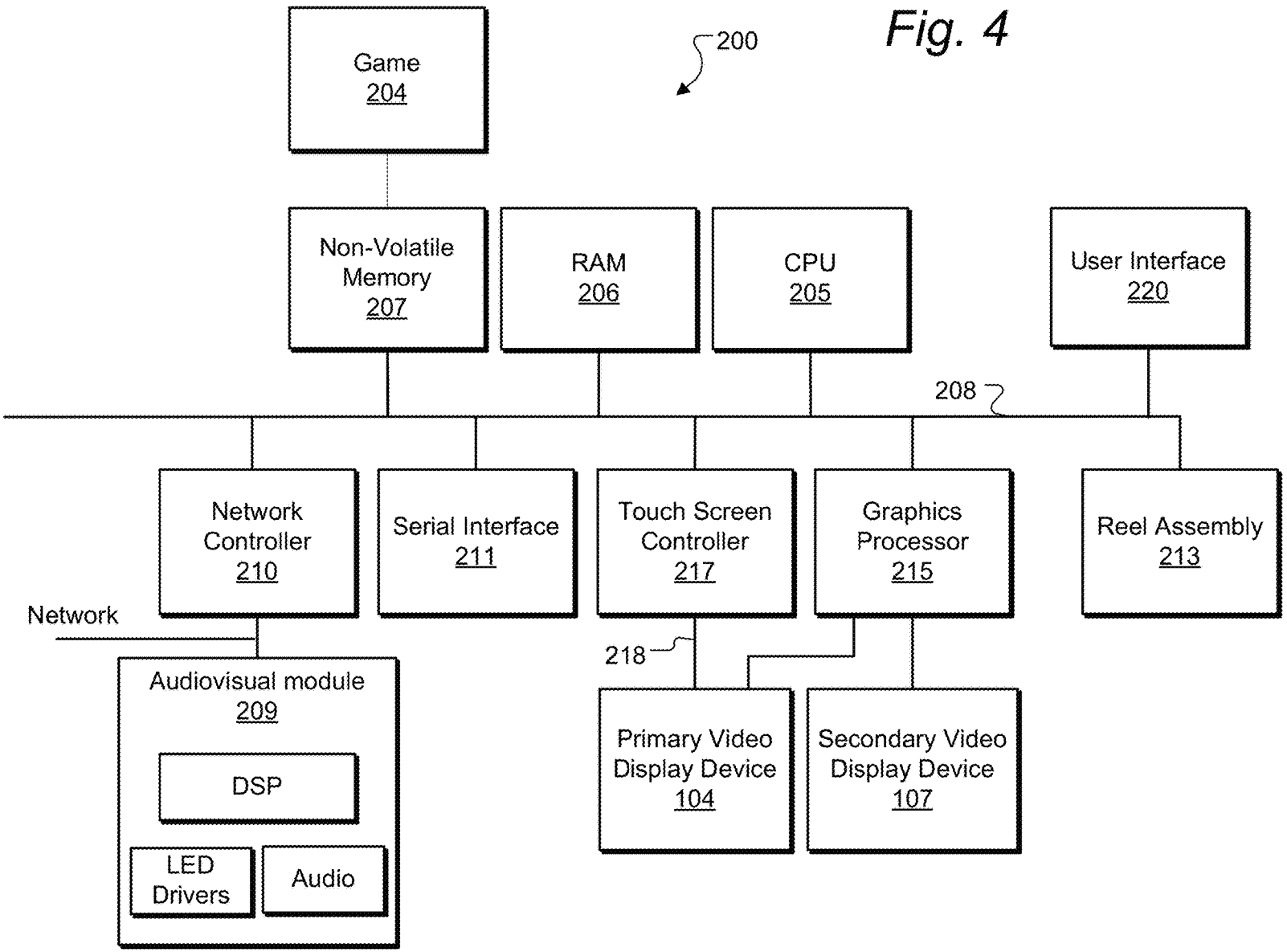
FIG. 4 is a block diagram showing various electronic components of the gaming machine shown in FIG. 2 together with additional gaming system components.

FIG. 4 shows a logical and hardware block diagram 200 of gaming machine suitable for implementing a gaming machine 100 of FIG. 2. The depicted block diagram 200 includes a central processing unit (CPU) 205 along with random access memory 206 and nonvolatile memory or storage device 207. All of these devices are connected on a system bus 208, a network controller 210, and a serial interface 211. An audiovisual module 209 may be provided at an audiovisual server connected to the gaming machine over a network connection through network controller 210. Audiovisual module 209 may be connected to multiple gaming machines over the network. A graphics processor 215 is also connected on bus 208 and is connected to drive primary video display device 104 and secondary video display device 107. As shown in FIG. 4, the gaming machine also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of primary video display device 104. The touch screen element itself is not illustrated or referenced separately in the figures.

Those familiar with data processing devices and systems will appreciate that other basic electronic components will be included in gaming machine such as a power supply, cooling systems for the various system components, audio amplifiers, and other devices that are common in gaming machines. These additional devices are omitted from the drawings so as not to obscure the present invention in unnecessary detail.

Audiovisual module 209, is depicted connected to the network controller, but may be connected to the system via a PCI bus, a USB bus, or through the network interface. In this embodiment, audiovisual module 209 is a processing module positioned in the bank of gaming machines or the gaming cabinet and communicatively connected to the speakers 116 and LED bezels 119 (FIG. 2). Audiovisual module 209 includes a digital signal processor (DSP) which processes audio data as described herein and controls LED drivers for LED bezels 119, and a sound card or other audio output system which drives speakers 116. The processing performed with the DSP of audiovisual module 209 is further described below.

System bus 208 is shown merely to indicate that the various components are connected in some fashion for communication with CPU 205 and is not intended to limit the invention to any particular bus architecture. Numerous other variations in the gaming machine internal structure and system may be used without departing from the principles of the present invention.

Elements 205, 206, 207, 208, 210, and 211 shown in FIG. 4 are known in the gaming industry. These elements are preferably mounted on a chassis and housed in a housing mounted in cabinet 101 shown in FIG. 2. Alternatively, the various electronic components may be mounted on one or more circuit boards housed within cabinet 101 without a separate enclosure such as those found in personal computers. Those familiar with data processing systems and the various data processing elements depicted will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 4 as being connected directly on system bus 208 may in fact communicate with the other system components through a suitable expansion bus.

The invention is not limited to any particular arrangement of processing devices for controlling the video display devices included with gaming machine 100. Also, a gaming machine implementing the present invention is not limited to any particular number of video display device or other types of display devices.

In the illustrated gaming machine 100, CPU 205 executes software which ultimately controls the entire gaming machine including the receipt of player inputs and the presentation of the graphic symbols displayed according to the invention through the display devices 104 and 107 associated with the gaming machine. As will be discussed further below, CPU 205 either alone or in combination with graphics processor 215 may implement a presentation controller for performing functions associated with a primary game that may be available through the gaming machine and may also implement a game client for directing one or more display devices at the gaming machine to display and perform the multimedia presentation techniques of the present invention. CPU 205 also executes software related to communications handled through network controller 210, and software related to various peripheral devices such as those connected to the system through serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included. In particular, network controller 210 provides an interface to a game controller which controls certain aspects of the player selection round as will be discussed below in connection with FIGS. 3A-B.

The depicted machine in operation is controlled generally by CPU 205 which stores operating programs and data in memory 207 with wagering game 204, user interface 220, network controller 210, audio/visual controllers, and reel assembly 213 (if a mechanical reel configuration). CPU or game processor 205 may comprise a conventional microprocessor, such as an Intel® Core i7 microprocessor, mounted on a printed circuit board with supporting ports, drivers, memory, software, and firmware to communicate with and control gaming machine operations, such as through the execution of coding stored in memory 207 including one or more wagering games 204. Game processor 205 connects to user interface 220 such that a player may enter input information and game processor 205 may respond according to its programming, such as to apply a wager and initiate execution of a game.

Figure 7:
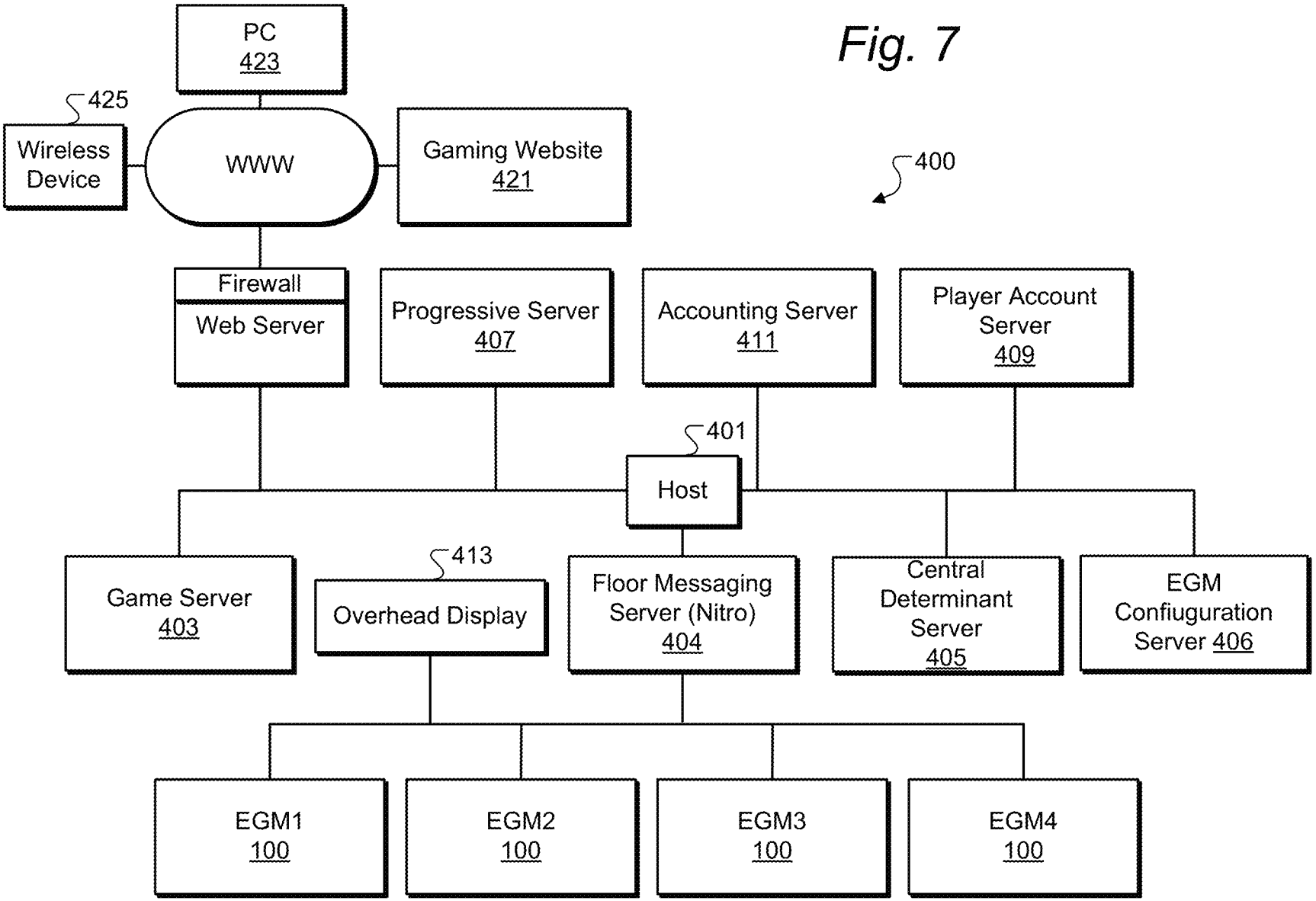
FIG. 7 is a system block diagram of a gaming system according to one embodiment of the present invention.

Game processor 205 also may connect through network controller 210 to a gaming network, such as example casino server network system 400 shown in FIG. 7.

Figure 5:
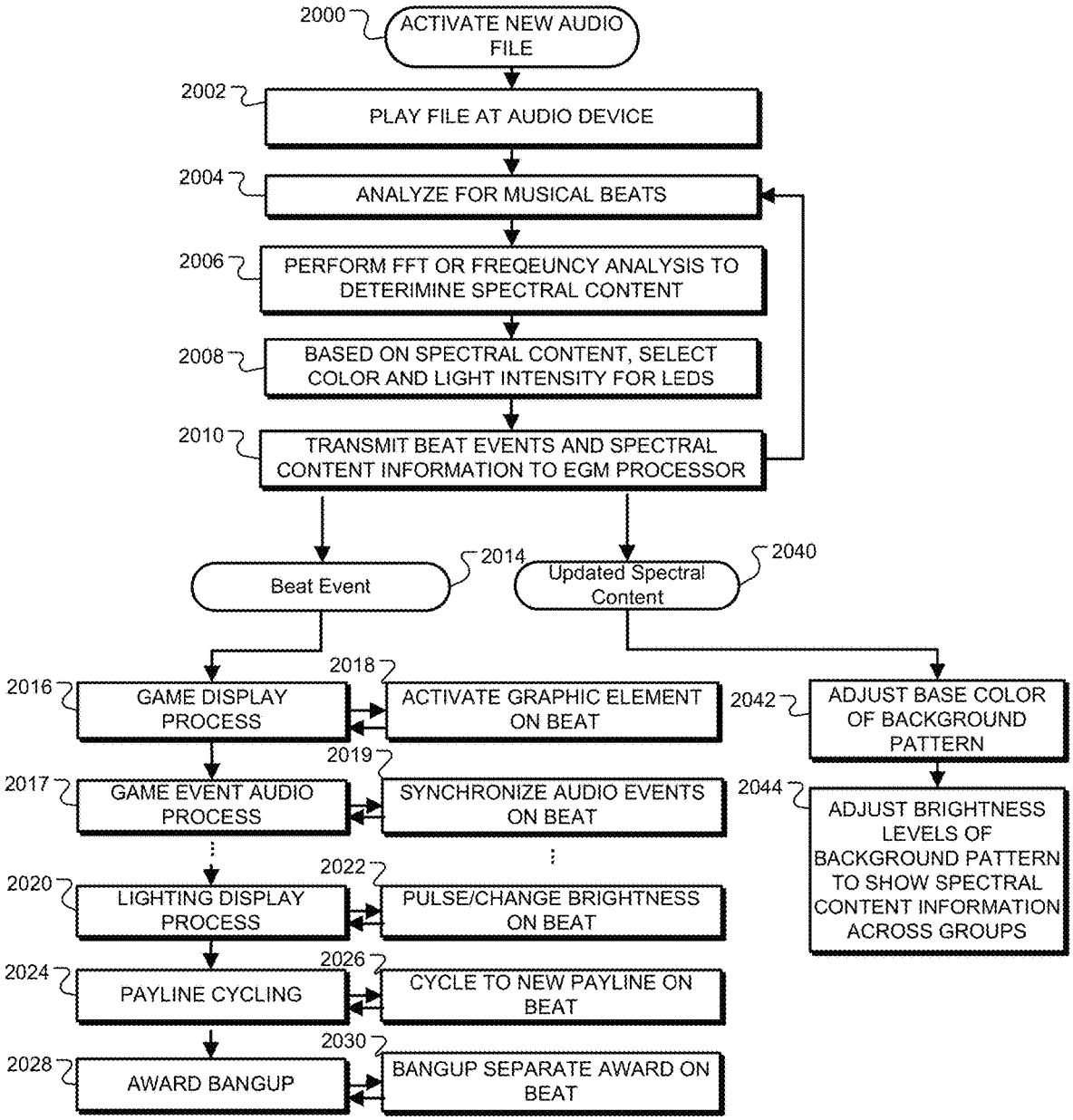
FIG. 5 illustrates in flowchart form a process of providing audiovisual accompaniment for a game according to some embodiments.

FIG. 5 illustrates in flowchart form a process of providing audiovisual accompaniment for a game according to some embodiments. This example process provides synchronization of music or other accompanying audio to the multimedia presentation of the wagering game for gaming machines such as machines 100 on a gaming network 400 such as that shown in FIG. 7. In this embodiment, the process is performed by an audiovisual module such as module 209 in cooperation with a gaming machine 100.

The depicted process allows any desired background music, assuming it a periodic beat or drum track to which the multimedia presentation is to be synchronized, to be provided for use at block 2000, where a new audio file is provided for playing at the gaming machine. Preferably, the same audio file and presentation is provided at an entire bank of gaming machines such as the bank depicted in FIG. 2. In some versions, new songs may be provided from various sources, or an audio track or stream may be provided including several songs, such as a live concert stream, which could be at a casino or a concert recording. As such, an audio file or audio stream may be provided at block 2000. The process also has the capability to receive input from an external source (preprogrammed), or through a microphone, which is mixed with the musical audio before the frequency analysis is conducted at block 2006. This enhances the group event presentation, providing an environment wherein the audience can cheer for a certain contestant, and that 'noise' can be translated into color/lights on each of the EGMs and overhead displays (and transmitted to remote locations).

The process at block 2002 receives an instruction that a first audio file or stream is to be played as a music accompaniment during a game play session, which instruction may come from state management software code running on the gaming machine, or from a central multimedia server or other suitable casino floor coordination system, and begins playing the audio file at the gaming machine's audio device.

Next the process begins an ongoing analysis process including blocks 2004, 2006, 2008, and 2020 which, on an ongoing basis while the audio file to played, analyzes the audio file to provide musical synchronization with gaming graphics at the gaming machine. While these blocks are depicted as being in order, typically the DSP performs some steps in parallel. Block 2004 identifies musical beats in the music audio file being played. This identification is typically performed by known audio analysis techniques, which may include identifying a spike or peak in audio power over a designated level or duration, or a spike across a wide spectrum of audio frequencies typical of a musical beat.

Block 2006 includes analyzing the audio file using a fast fourier transform or other frequency analysis to identify spectral content information concerning audio being played. The result is spectral content information from a measurement of a power or energy level measurement of the audio signal over a designated period, typically a few milliseconds, indicating the energy level at a number of frequencies or frequency bands used in the frequency analysis. This type of analysis may be described as "real time", that is it produces results quickly enough to be used in the audiovisual presentation without any delay being noticeable to the user. Such analysis may include a slight "lead time" in processing the audio signal to allow for frequency analysis results to be available when the audio is played. For example, a 100 ms delay or 200 ms delay before the audio is actually played may be used to allow the frequency analysis to be completed and be available on an ongoing basis while the audio is being played. Preferably this analysis is conducted on an ongoing basis, repeating with every interval of audio sufficient to provide enough data for the analysis.

Based on the spectral content information, the process at block 2008 selects at least one of a color and a light intensity level at which to activate the LEDs and causing the LED drivers to activate the LEDs. This block may include mapping the spectral content information onto a set of spectrum bands and magnitude levels to be expressed the LEDs, and related display elements as further described below, in order to achieve a graphic equalizer effect depicting the audio spectrum visually. For example, if the LEDs are grouped to display spectral content with a set of eight frequency bands across the audio spectrum, with ten quantized energy levels in the bands relating to ten brightness levels that are used in the LED or display element, then the spectral content information is mapped to this set of frequency and quantized energy levels. While eight bands are discussed in the examples herein for simplicity, in a preferred version many more bands are used.

The spectral content information may also be used to select a base color or set of colors to use for the LEDs. For example, the particular musical key of the song may be used to select a base color. Or, the identification of a transition in the music, for example from verse to chorus, may result in a change of the base color of the LEDs. In other embodiments, other information may be used in addition to or instead of the spectral content information to select a base color. For example, a color may be chosen for each new song that is played. Block 2008 also includes sending the resulting color and intensity levels to the LED drivers, causing the LEDs to flash or adjust according to the desired display. If the LEDs are used to display a varied spectrum, quantized spectral content information is used to drive a selected set of LEDs at different levels to achieve a graphic equalizer effect with the LED display.

At block 2010, the process transmits the beat events synchronized with identified musical beats, and transmit the spectral content information, to one of the electronic controllers at the gaming machine. This is done on an ongoing basis as soon as updated information is available from the ongoing analysis of beats and frequency information. In some embodiments, the spectral content information may be transmitted over a network connection, for example when a DSP at an audio server performs blocks 2002-2008 for a group of gaming machines, such as a bank of gaming machine like that depicted in FIG. 2. In other embodiments, the spectral content information is sent from an audiovisual module at a gaming machine to an electronic controller for the gaming machine. This block transmits beat events 2014 and updated spectral content information 2040 as shown on an ongoing basis.

The events are received at a gaming machine and may be received at multiple gaming machines in a designated group such as a bank of machines. At the gaming machine, the process continues under of at least one electronic controller. The gaming machines each include a second tangible, non-transitory electronically accessible memory coupled to the at least one electronic controller and containing program code executable by the at least one electronic controller to respond to the beat events and updated spectral content information. Generally, the process at the gaming machine provides an audiovisual display synchronized with the beats in the played audio, presenting dynamic background graphics on the gaming display associated with the beat events and the spectral content information.

Blocks 2016-2030 show the dynamic response to beat events, and blocks 2040-2044 show the response to updated spectral content information. In response to the beat events and synchronized with the beats in the played audio, the gaming machine game display process at block 2016 receives the beat event and, in response, causes dynamic animations of graphical display elements on the display during the game play session as shown at block 2018. The beat event may be distributed to the various running processes at the gaming machine as an inter-process message through a virtual message bus such as the Spread Unified Messaging Bus, or may be another suitable type of software message or interrupt event. Different processes or code modules may be running that respond differently to a beat event. Generally, the different processes at blocks 2016, 2017, 2020, 2024, and 2028 may not always be running as process threads or related groups of process threads, or may be placed in a state in which they do not respond to beat events. The block diagrams herein show behavior in which such processes are, according to their programming, in a state to respond to the beat events as depicted. The game display process, as shown at block 2016, may activate any number of graphic elements on a beat, such as animating a flash or pulse of light for a reel symbol 52, or animating a change in reel symbols with the beat. The game display process may also animate the background graphics 53 in time with the music beat. While the term "process" is used here, one or more than one actual microprocessor process, or thread, of related software instructions may run to control the steps described in response to the beat event. A single process may also control the response for more than one of the depicted events at blocks 2018, 2019, 2022, 2026, and 2030 and other similar events. In some versions, beat events are sent as an inter-process message on a virtual unified message bus. Such messages may be sent between networked devices, over a local bus, or to different processes in the same processor, which may be running on different processor cores or the same processor core.

The game event audio process at block 2017 is another process that may respond to beat events. The software further comprises instructions for providing game event audio accompanying selected events in the game play session at block 2019, and further operable to mix the game event audio with the played audio such that designated sounds (typically beats or emphatic sounds) in the game event audio are synchronized with the beats in the played audio.

It is noted the ellipsis between blocks 2017 and 2020 shows more gaming processes may be present which respond in different ways to beat events in the game soundtrack or background music. The depicted order of events is not limiting as the processes are typically event driven and run in parallel.

Next at block 2020 the gaming machine lighting display process software code (which is generally part of the multimedia display software modules in the gaming software, but may include drivers and other related code), receives the beat event and goes on to respond in some cases, as programmed, to pulse, flash, change color, or otherwise adjust the lighting condition or state synchronized in time to the soundtrack beat. In some embodiments, light adjustments may be managed entirely by the audiovisual module and not performed directly by the gaming machine processors. As shown in the next several blocks, designated ones of the beat events may trigger responses from various game play processes executing in the game.

Next at block 2024, a payline cycling process is shown to receive the beat event. This process runs during the award phase of a winning game in which the wagering game includes multiple paylines which are evaluated for game results in a payline evaluation phase of the game play session. The response software code typically includes instructions for providing a graphical display of cycling through the payline evaluation synchronized with the beats in the played audio, as seen at block 2026. The beats can be main beats of a measure, with no response on off beats, mimicking an arrangement in which the display has a custom animation sequence for each song.

Next at block 2028 the process has another gaming presentation process that receives and responds to beat events, the award bang-up process, which shows awards from base or bonus games being added to the players credit total. The award bang-up process at block 2028 will be activated after designated winning outcomes, and may wait for the first beat event before making any multimedia presentation of the award bang-up. This process typically controls both audio and display animation to show the credit meter 'bang-up' at block 2030. The audio includes a bang-up soundtrack synchronized with the beats in the played audio, and a bang-up graphic sequence is displayed with the bang-up soundtrack showing credits incrementally awarded to a player also synchronized with the beats in the played audio.

Consistent with the structure of music in measures having down beats and off beats, the beat messages may have DOWN BEAT type and OFF BEAT type, or the timer or processes may count beats the beats to identify a beat message as such, and processes may respond differently to different beat types. The various processes at blocks 2016, 2017, 2020, 2024, and 2028 may include setting timers based on the start of a beat event which control animations that occur over time in response to the beat event.

At block 2040, the updated spectral content information is received by a multimedia display process at the gaming machine. This may be accomplished through inter-thread messaging as described above. In response to receiving the updated spectral content information, the process makes adjustments to the background graphics 53 (FIG. 3) to provide a dynamic background display. Block 2042 may alter the base color of colored elements in the background to conform to color changes of the LEDs in response to changes in the spectral content information. For example, colored elements 50 in background graphics 53 may have their base color altered if the LED bezels are also being altered, presenting a uniform base color scheme for the entire gaming machine or the bank of gaming machines.

At block 2044, the process adjusts the brightness level of colored elements to show the spectral content information across one or more designated groups of colored elements. In the example embodiment of FIG. 3, the dynamic background graphics 563 include a regular pattern of colored elements 50 at least some of which are arranged in a group having displayed brightness levels varying within the group according to the spectral content information. In this version, the groups are defined along the vertical edges of primary display 104, with two more groups defined vertically at the center facing right and left. Graphic variations may be applied to alter the brightness levels, for example in a preferred version the brightness levels are adjusted by moving amorphous "blobs" that may move along background graphics 53 similarly to a lava lamp bubble, raising the brightness of the colored elements 50 within the blob as it moves along the colored elements. Using the example discussed above, the audio frequency band is divided into eight frequency ranges, which are then mapped onto the group. Many other suitable groupings may be used, for example straight left to right or vertical groupings may be used. Or a graphic equalizer may be presented directly in any desired orientation with a number of bars or zones.

The use of a DSP to perform real time analysis of the audio file as it being played has the advantage of eliminating pre-processing steps that are typically required to synchronize game graphics with the accompanying audio. Typically an audio file is processed and markers are added to designate events in the audio such as beats which should have accompanying animations in the game presentation. Using the techniques herein, the DSP essentially creates the markers as the music is played. In various embodiments, the DSP is programmed to be 'listening' for certain events, or sequences of events, and trigger the game to perform certain activities. For example, a change in musical tempo may be detected and, in response, the base color scheme of the LEDs and background graphics may be changed. Or, a drum rif can be detected and, in response, an animation such as a flashing or highlighting of elements in the background or game display may be performed.

It should be noted that the audiovisual presentation process herein may occur when the gaming machine is being played in a base game mode, in a tournament mode, or when the gaming machine is in an "attract" mode in which no active game play session is in progress at the machine. A game play session is begun when a player logs in to a credit account on the gaming machine, or deposits credits in the form of cash or a voucher or token of some kind. To begin a game play, the method receives a wager from the game player, which typically consists of some input from the player to set the amount to be wagered from their credit amount on the machine. This step may also be carried over from previous game rounds by simply starting the game with the previous wager amount set. Then, the machine receives a play input from the player. This typically happens through a 'Play' button on the game cabinet or touchscreen display, and serves to place the wager and start a single round of game play in the base game. In embodiments having reels, reel displays, or simulated reels, this is conducted by spinning the reels. Other embodiments may otherwise rearrange or randomize the symbols on the matrix in any suitable manner. After the game activation, the machine randomly determines the game outcome, preferably by randomly determining a set of reel stops that determine which symbols fill the matrix for the current game outcome. For games that use other scrambling besides simulated reels, the random outcome is determined at this step as appropriate for the game. The preferred version generates at least one random number and uses the at least one random number to determine a set of game reel stops specifying a position in which multiple simulated or mechanical reels will stop to display symbols in a symbol array in a spin outcome for the wager.

Further, while the system computer executable instructions described above are preferably executed by a Class III gaming machine as further discussed below, it should be understood that this is only one example embodiment, and other versions may divide the processing tasks of the game method in a different manner. For example, some systems may employ a thin client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring "at the gaming machine." In the depicted method, the method is performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (i.e. 403).

Figure 6:
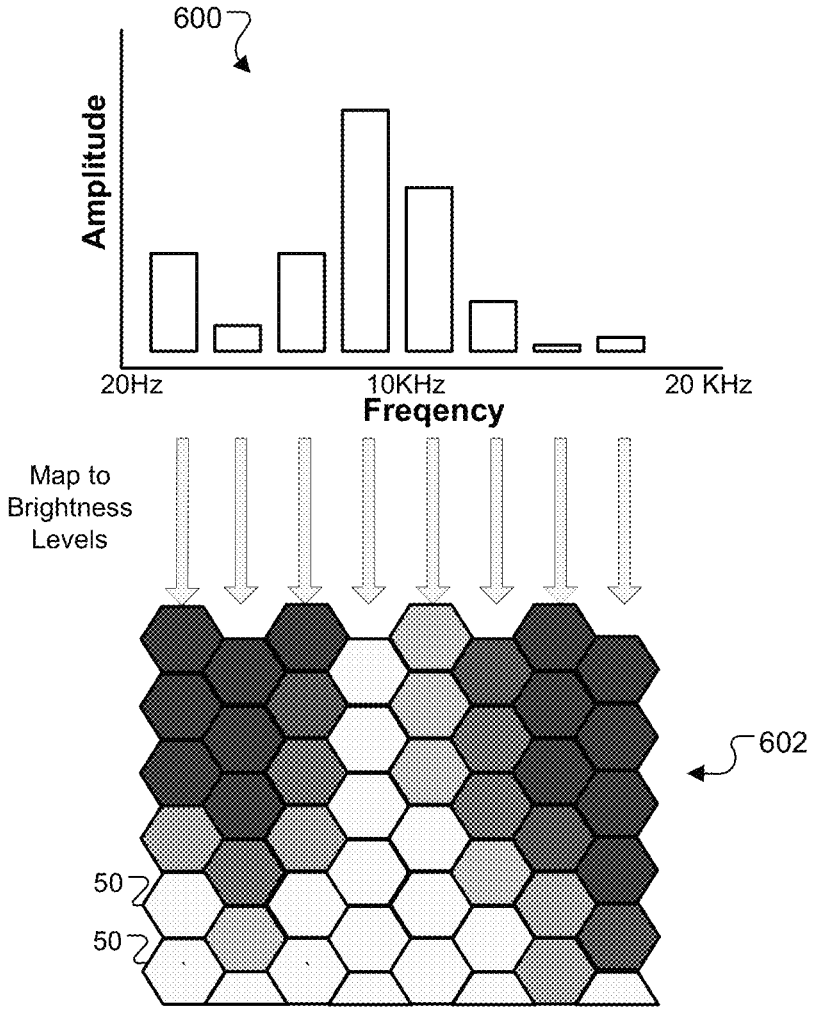
FIG. 6 illustrates in diagram form a process of applying spectral content information according to some embodiments.

FIG. 6 illustrates in diagram form a process of applying spectral content information according to some embodiments. The depicted process is one example of the adjustment process that may occur at blocks 2008 and 2044 of FIG. 5, for example. At each window or period of audio that is analyzed at block 2006, a set of spectral content information like the depicted example spectral content information 600 is produced. For each of a designated set of frequency bands, in this example eight, the audio amplitude (power level or energy over the time analyzed) is determined. As depicted on the horizontal axis of the chart showing spectral content information 600, the frequency bands are distributed over the audible frequency spectrum, approximately 20 Hz to 20 KHz. The vertical height of the bars depicts the audio amplitude, but the spectral content information sent to the gaming machine is typically a set of numbers representing the amplitudes in the bands.

As shown in the diagram, the spectral content information is mapped to a group of colored elements 50. In this embodiment, the spectral content information is presented in a graphic form by groups 602 of colored elements 50 forming lighted bars similar to a graphic equalizer display. Higher audio power in an audio frequency band maps to a larger bar of bright elements in the group display, while lower power in the audio frequency band maps to a short bar. The bars are arranged to extend from the side edges of display 104 in the background display area, and have more than the eight depicted frequency bands. In this version, each frequency band maps to a single line of colored elements 50 from the group 602. Different groups may respond differently to the spectral content information.

Referring to FIG. 7, a block diagram of an example casino server network system 400 associated with one or more gaming facilities is shown, including one or more networked gaming machines 100 in accordance with one or more embodiments. While some of the servers have been shown separately, they may be combined or split into additional servers having additional capabilities.

Casino server network 400 may be implemented over one or more site locations and include host server 401, and an EGM configuration server 406 (in the preferred version the Everi Games Nitro Host server) for managing the configuration of multiple EGMs 100 on the network. A group display device 408 is coupled to network 400 may include its own controller and graphics processor for driving the group display in response to commands received over a network connection. The network may also include remote game play server 403 (which may be configured to provide game processor functionality including determining game outcomes and providing audio/visual instructions to a remote gaming device), a floor messaging server 404, central determinant server 405 (which may be configured to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

As shown, networked gaming machines 100 (EGM1-EGM4) and one or more overhead group displays 408 may be network connected and enable the content of one or more displays of gaming machines 100 to be mirrored or replayed on an overhead display. EGMs 100 may also feed celebration graphics directly to the overhead displays 413 in the course of providing games, for example to show a celebration for a large bonus win or group gaming mode win on a particular EGM 100. Typically the overhead display function, including the control of overhead group display 109 (FIG. 2), which is one embodiment of overhead display 413, and group celebration scenarios are managed by a floor messaging server such as Nitro floor messaging server 404, which receives messages from EGM's 100 to communicate group gaming mode wins, bonus game wins, or awards of other large prizes such as progressive prizes. In this embodiment, floor messaging server 404 contains audiovisual module 209 and performs the spectral analysis and beat detection discussed above. Floor messaging server 404 also controls LED bezels 119 as described above. A separate floor messaging server 404 may be provided to perform such functions for each group of gaming machines, for example each bank of gaming machines on the casino floor. The primary display content may also be provided by a selected gaming machine in the bank during celebration events, stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective player's video images may be displayed on overhead display 413 along with the content of the player's gaming machine 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Progressive prizes may be made available to be won through display on the group gaming board in group gaming mode, as they are in base gaming mode. Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e. g. game personalizing selections or options). For example, the player tracking display may be programmed to display a player menu that may include a choice of personalized gaming selections that may be applied to a gaming machine 100 being played by the player.

Other gaming machines through which the automated multimedia presentation techniques herein are implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement the base game within the scope of the present invention using an electro mechanical arrangement or even a purely mechanical arrangement for displaying the symbols needed to complete the game as described herein. However, the most preferred forms of the invention utilize one or more video display devices for displaying the spinning reels, the animated symbols, and the other synchronized multimedia animations.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Blackberry® cell phone, Apple® iPhone®, personal data assistant (PDA), iPad®, etc.). To enter the website, a player may log in with a username (that may be associated with the player's account information stored on player account server 409 or be accessible by a casino operator to obtain player data and provide promotional offers), play various games on the website, make various personalizing selections, and save the information, so that during a next gaming session at a casino establishment, the player's playing data and personalized information may be associated with the player's account and accessible at the player's selected gaming machine 100.

Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

For example, while gaming machines and group displays are described herein to present the results of the audiovisual presentation techniques, the resulting display elements may also be presented on other displays in the casino gaming environment, such as signs and LED display wedges arranged near the gaming machines. Such additional displays may be dynamically switched between 'passive flashing lights', 'active color' music synchronization, and 'active crowd noise analyzer/display', or blended to be any proportion of these.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method conducted in cooperation with gaming machine having a display, a wager input device, an audio device, and at least one electronic controller operatively coupled to the wager input device and the display and configured to execute instructions related to a wagering game, the method comprising:

(a) causing the audio device to play audio from an audio file;

(b) while causing the audio file to played, analyzing the audio file at a digital signal processor (DSP) to identify musical beats and creating beat events in response;

(c) analyzing the audio file using one of a fast fourier transform or frequency analysis to identify spectral content information concerning audio being played;

(d) using the spectral content information, selecting at least one of a color and a light intensity level at which to activate a plurality of LEDs arranged along bezels of the gaming machine and causing LED drivers to activate the LEDs;

(e) transmitting the beat events and the spectral content information to one of the electronic controllers;

(f) receiving the beat events at one of the electronic controllers and, in response to the beat events and synchronized with the beats in the played audio, animating graphic elements on the display during a game play session at the gaming machine; and (g) presenting dynamic background graphics on the display based on the spectral content information.

2. The method of claim 1, wherein the dynamic background graphics include a regular pattern of colored elements at least some of which are arranged in a group having displayed brightness levels varying within the group according to the spectral content information.

3. The method of claim 2, in which the colored elements are altered to conform to color changes of the LEDs in response to designated changes in the spectral content information.

4. The method of claim 1, wherein causing the audio device to play the audio file and analyzing the audio file are performed at an audiovisual assembly coupled to the gaming machine.

5. The method of claim 1, further comprising, under control of the at least one electronic controller, providing game event audio accompanying selected events in the game play session, and further operable to mix the game event audio with the played audio such that designated sounds in the game event audio are synchronized with the beats in the played audio.

6. The method of claim 1, in which the wagering game includes multiple paylines which are evaluated for game results in a payline evaluation of the game play session, the method further comprising providing a graphical display of cycling through the payline evaluation synchronized with the beats in the played audio.

7. The method of claim 1, further comprising synchronizing animations of gaming symbols on an array of symbols with beats in the played audio.

8. A gaming machine for providing a wagering game, the gaming machine comprising:

a cabinet housing a display, a wager input device, and at least one electronic controller operatively coupled to the wager input device, and the display and configured to execute instructions related to the wagering game and to cause cash value credits to be awarded to a player in response to wagering wins;

an audiovisual assembly connected to cabinet housing and including an audio device, a plurality of LED bezels each including LEDs with electronically controlled variable colors, LED drivers coupled to control the LEDs, and a digital signal processor (DSP) coupled to the audio device and the LED drivers;

a first tangible, non-transitory electronically accessible memory coupled to the DSP and containing program code executable by the DSP to receive an instruction that an audio file is to be played as a music accompaniment during a game play session and, in response:

(a) causing the audio device to play audio from an audio file;

(b) while causing the audio file to played, analyzing the audio file to identify musical beats and in response creating beat events;

(c) analyzing the audio file using one of a fast fourier transform or frequency analysis to identify spectral content information concerning audio being played;

(d) using the spectral content information, selecting at least one of a color and a light intensity level at which to activate the LEDs and causing the LED drivers to activate the LEDs; and (e) transmitting the beat events, and transmitting the spectral content information, to one of the electronic controllers;

a second tangible, non-transitory electronically accessible memory coupled to the at least one electronic controller and containing second program code executable by the at least one electronic controller to:

(f) in response to the beat events and synchronized with the beats in the played audio, animating graphical elements on the display during the game play session; and (g) presenting dynamic background graphics on the display based on the spectral content information.

9. The gaming machine of claim 8, wherein the dynamic background graphics include a regular pattern of colored elements at least some of which are arranged in a group having displayed brightness levels varying within the group according to the spectral content information.

10. The gaming machine of claim 9, in which the colored elements are altered to conform to color changes of the LEDs in response to designated changes in the spectral content information.

11. The gaming machine of claim 8, in which the second program code further comprises instructions for providing game event audio accompanying selected events in the game play session, and further operable to mix the game event audio with the played audio such that designated sounds in the game event audio are synchronized with the beats in the played audio.

12. The gaming machine of claim 8, in which the second program code further comprises instructions for synchronizing animations of gaming symbols on an array of symbols with beats in the played audio.

* * * * *